US008806670B2

(12) United States Patent
O'Connell

(10) Patent No.: US 8,806,670 B2
(45) **Date of Patent: *Aug. 19, 2014**

(54) SYSTEMS FOR MOVING SHOWER RODS

(76) Inventor: Colleen O'Connell, Sarasota, FL (US)

( * ) Notice: Subject to any disclaimer, the term of this patent is extended or adjusted under 35 U.S.C. 154(b) by 798 days.

This patent is subject to a terminal disclaimer.

(21) Appl. No.: 13/013,581

(22) Filed: Jan. 25, 2011

(65) Prior Publication Data

US 2011/0113547 A1 May 19, 2011

Related U.S. Application Data

(63) Continuation-in-part of application No. 12/285,059, filed on Sep. 29, 2008, now Pat. No. 8,069,508.

(60) Provisional application No. 60/976,387, filed on Sep. 28, 2007, provisional application No. 60/976,394, filed on Sep. 28, 2007.

(51) Int. Cl.
*A47K 3/00* (2006.01)

(52) U.S. Cl.
USPC ..... 4/610; 4/605; 4/608; 248/261; 248/264; 248/265; 211/105.1; 211/119.009; 211/119.011; 211/123

(58) Field of Classification Search
USPC ..... 4/558, 605, 610, 559, 608; 248/251, 248/252; 160/333
See application file for complete search history.

(56) References Cited

U.S. PATENT DOCUMENTS

| | | | | |
|---|---|---|---|---|
| 2,840,827 | A * | 7/1958 | Calvano | 4/558 |
| 4,122,559 | A * | 10/1978 | Kelly | 4/608 |
| 2005/0268394 | A1 * | 12/2005 | Monk et al. | 4/558 |
| 2007/0174956 | A1 * | 8/2007 | Heaslip | 4/558 |

FOREIGN PATENT DOCUMENTS

| | | | |
|---|---|---|---|
| CN | 201295116 | Y | 8/2009 |
| CN | 201328661 | Y | 10/2009 |

* cited by examiner

*Primary Examiner* — Gregory Huson
*Assistant Examiner* — Lauren Heitzer
(74) *Attorney, Agent, or Firm* — Maier & Maier, PLLC

(57) ABSTRACT

A rotatable shower rod system may be provided. The system may include a pair of mounting brackets coupled to a wall, the pair of mounting brackets includes a stationary portion; a rotatable portion rotatably coupled to the stationary portion, the rotatable portion rotates to at least one of a first position and a second position about an axis of rotation; and a cover coupled to the stationary portion; and a curved rod extending between the pair of mounting brackets.

12 Claims, 16 Drawing Sheets

SYSTEMS FOR MOVING SHOWER RODS

CROSS-REFERENCE TO RELATED APPLICATIONS

This application is a continuation-in-part of application Ser. No. 12/285,059, now U.S. Pat. No. 8,069,508, filed Sep. 29, 2008, which claims priority to 60/976,387, filed Sep. 28, 2007 entitled SHOWER ROD ROTATOR BRACKET and 60/976,394 filed Sep. 28, 2007 entitled SHOWER ROD SLIDING BRACKET, the entire contents of which are hereby incorporated by reference.

BACKGROUND OF THE INVENTION

Well known examples of bathroom layouts generally have a shower configuration that includes a bathtub and a hanging shower curtain. In such well known examples, the bathtub is enclosed on three sides by walls with the shower curtain substituting a fourth wall.

In an effort to increase an abode's livable space, many home designers and developers will sacrifice bathroom space to facilitate increasing the livable space. This is especially well known in condominiums or guest areas of a house. Condominium bathrooms are generally small such that the square footage of the livable space is increased. Moreover, the guest areas of a house, such as a guest bathroom, are typically smaller than the master bathroom and other more frequently used areas of the house to facilitate increasing the size of those more frequently used areas. As a result, such guest bathrooms generally have smaller shower areas than users would prefer.

Users of smaller shower areas may wish to increase the size of their shower area. One known example of increasing the shower area is to use a curved shower rod. Such shower rods facilitate increasing the shower space by curving a shower liner away from the shower space. As a result, the space within the shower area is increased. However, the curved shower rod also facilitates decreasing the amount of bathroom space outside of the shower.

BRIEF DESCRIPTION OF THE INVENTION

In one aspect, a rotatable shower rod system may be provided. The system may include a pair of mounting brackets coupled to a wall, the pair of mounting brackets includes a stationary portion; a rotatable portion rotatably coupled to the stationary portion, the rotatable portion rotates to at least one of a first position and a second position about an axis of rotation; and a cover coupled to the stationary portion; and a curved rod extending between the pair of mounting brackets.

In another aspect, a slidable shower rod system may be provided. The system may include a pair of mounting brackets coupled to a wall, the pair of mounting brackets may include a wall mount; a sliding assembly coupled to said wall mount, the sliding assembly may include a stationary portion; a first sliding portion slidably coupled to the stationary portion; and a second sliding portion slidably coupled to the first sliding portion; and a rod coupled to the pair of mounting brackets such that the rod may extend between the pair of mounting brackets, the pair of mounting brackets facilitate sliding the rod to at least one of a first position and a second position.

In yet another aspect, a means for moving a shower rod may be provided. The means may include a means of moving a rod between at least one of a first position and a second position using a pair of mounting brackets; and a means of coupling the rod to the pair of mounting brackets.

BRIEF DESCRIPTION OF THE DRAWINGS

Advantages of embodiments of the present invention will be apparent from the following detailed description of the exemplary embodiments thereof. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance, or illustration." The embodiments described herein are not limiting, but rather are exemplary only. It should be understood that the described embodiment are not necessarily to be construed as preferred or advantageous over other embodiments. Moreover, the term "embodiments of the invention" does not require that all embodiments of the invention include the discussed feature, advantage or mode of operation.

Figure 1:
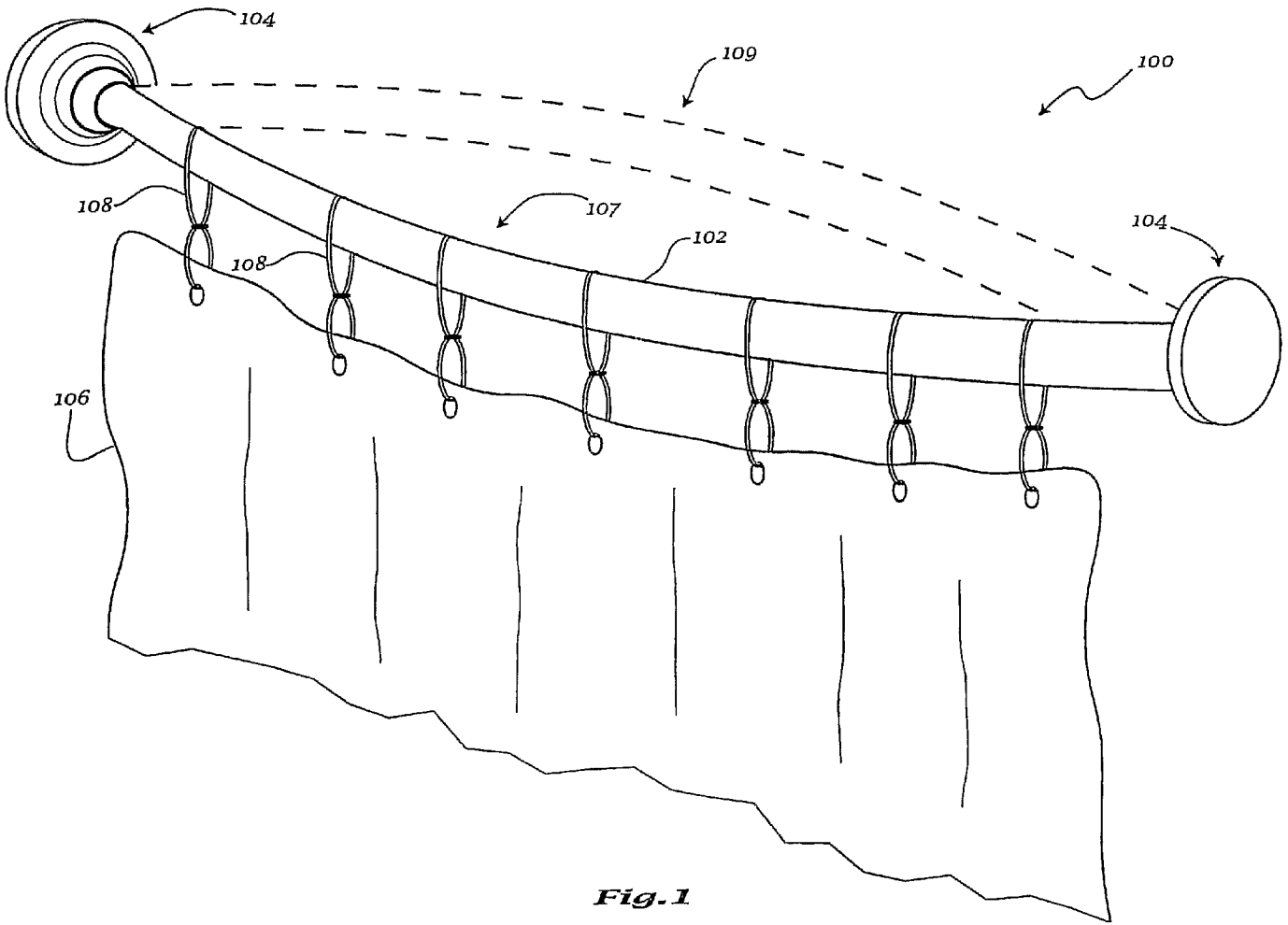
FIG. 1 is a perspective view of a rotatable shower rod system.
Figure 2:
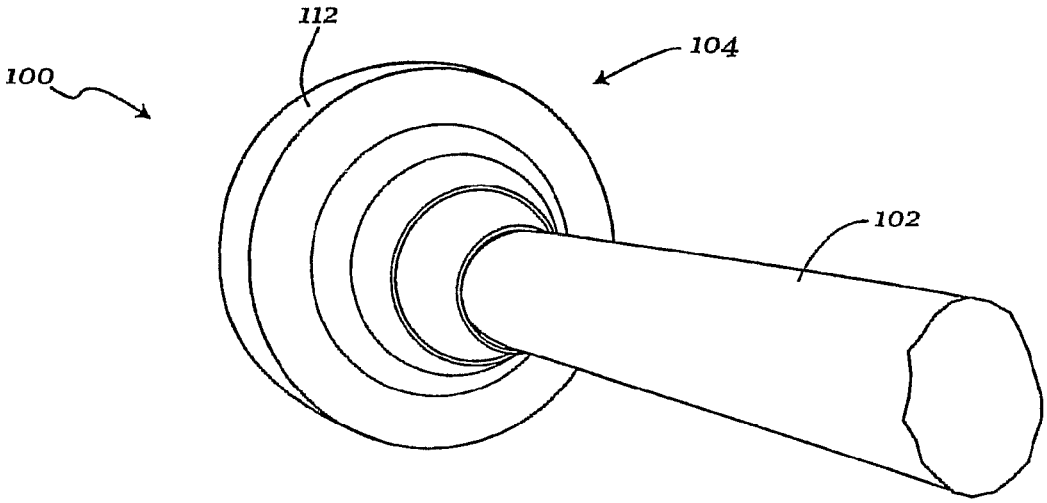
FIG. 2 is an enlarged perspective view of the rotatable shower rod system shown in FIG. 1.

FIG. 1 is a perspective view of a rotatable shower rod system 100. FIG. 2 is an enlarged view of rotatable shower rod system 100. In the exemplary embodiment, system 100 may include a curved rod 102, a pair of mounting bracket assemblies 104, a shower liner 106, and a plurality of liner fasteners 108. Each mounting bracket assembly 104 may include a rotator mount assembly 110 (shown in FIGS. 3*a*-3*c*) and a cover 112. Moreover, each mounting bracket assembly 104 may be coupled to a support structure, such as a shower wall (not shown). Mounting bracket assemblies 104 may be coupled to opposite facing walls such that one mounting bracket assembly 104 is positioned substantially opposite from the other mounting bracket assembly 104, wherein curved rod 102 may extend therebetween. Curved rod 102 may be rotatably coupled to each mounting bracket assembly 104, as described in more detail below. Liner 106 may be slidably coupled to curved rod 102 using the plurality of liner fasteners 108. In the exemplary embodiment, mounting bracket assemblies 104 facilitate rotating curved rod 102 from a first position 107 to a second position 109, as described in more detail below.

Figure 3A:
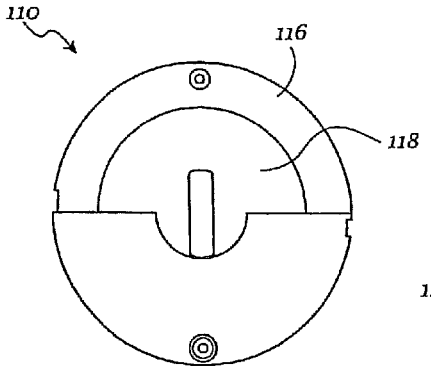
FIG. 3*a* is a front view of a rotator mount assembly that may be used with the system shown in FIG. 1.
Figure 3B:
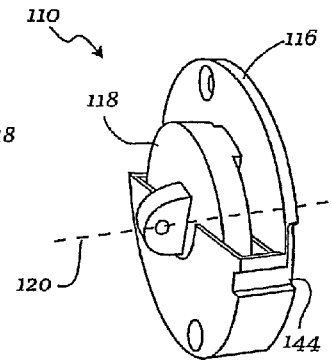
FIG. 3*b* is a perspective side view of the rotator mount assembly shown in FIG. 3*a;*
Figure 3C:
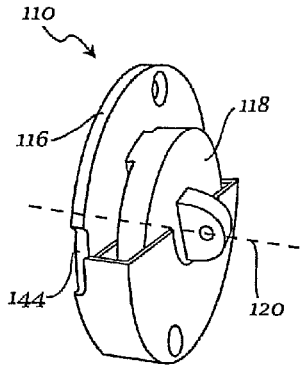
FIG. 3*c* is a perspective side view of the rotator mount assembly shown in FIG. 3*a;*

FIG. 3*a* is a front view of rotator mount assembly 110 that may be used with mounting bracket assembly 104, FIG. 3*b* is a perspective side view of rotator mount assembly 110 and FIG. 3*c* is another perspective side view of rotator mount assembly 110. Rotator mount assembly 110 may include a stationary portion 116 and a rotatable portion 118 that may be rotatably coupled thereto. As a result, rotatable portion 118 may rotate with respect to stationary portion 116 about an axis of rotation 120, as described in more detail below.

Figure 4A:
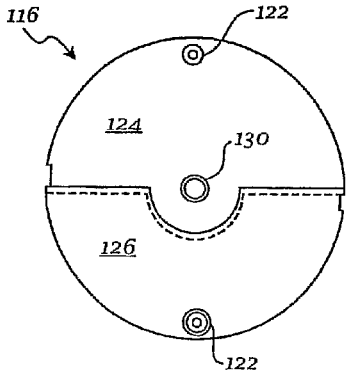
FIG. 4*a* is a front view of a stationary portion that may be used with the system shown in FIG. 1.
Figure 4B:
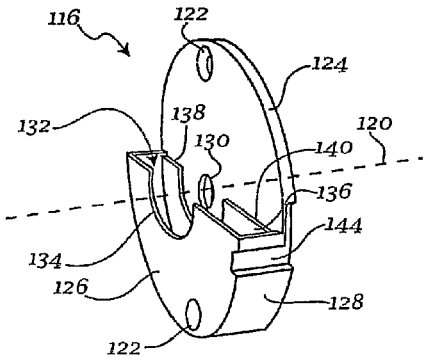
FIG. 4*b* is a perspective view of the stationary portion shown in FIG. 4*a;*

FIG. 4*a* is a front view of stationary portion 116 and FIG. 4*b* is a perspective side view of stationary portion 116. Stationary portion 116 may have a plurality of mounting holes 122 defined therein to enable stationary portion 116 to be coupled to the wall using a plurality of mounting fasteners (not shown). In the exemplary embodiment, stationary portion 116 may include a first plate 124, a second plate 126 and a sidewall 128 extending generally axially therebetween. First plate 124 may have a substantially circular shape and may include a center-hole 130 defined therein. Alternatively, stationary portion 116 may have a substantially oval shape and/or any polygonal shape that enables system 100 to function as described herein. Second plate 126 may have a substantially semi-circular shape and may be coupled to sidewall 128 such that a cavity 132 is defined between first plate 124, second plate 126 and sidewall 128. Cavity 132 may be configured to receive at least a portion of rotatable portion 118, as described in more detail below. Alternatively, second plate 126 may, have a substantially oval shape and/or any polygonal shape that enables system 100 to function as described herein. Second plate 126 may also have a semi-circular notch 134 defined therein, which enables rotatable portion 118 to rotate about axis of rotation 120, as described in more detail below. Alternatively, notch 134 may be any shape that enables system 100 to function as described herein. First plate 124 may also include a protrusion 136 that may extend away from first plate 124 towards second plate 126, wherein protrusion 136 may extend partially into cavity 132. Moreover, protrusion 136 may be positioned substantially opposite second plate 126. In the exemplary embodiment, protrusion 136 may include a first contact surface 138 and a second contact surface 140 to facilitate stopping the rotation of rotatable portion 118, as described in more detail below. Stationary portion 116 may also include a plurality of locking slots 144 that facilitate coupling cover 112 to stationary portion 116.

Figure 5A:
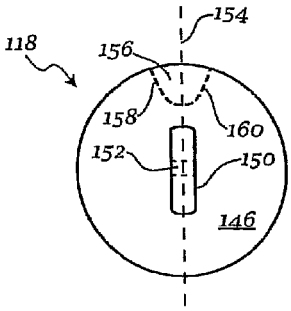
FIG. 5*a* is a front view of a rotatable portion that may be used with the system shown in FIG. 1.
Figure 5B:
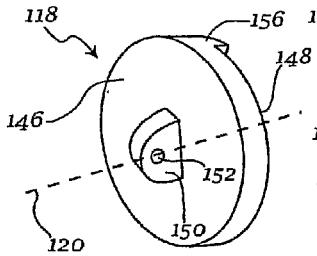
FIG. 5*b* is a perspective front view of the rotatable portion shown in FIG. 5*a;*
Figure 5C:
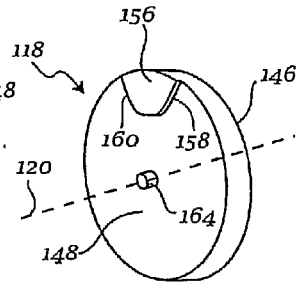
FIG. 5*c* is a perspective rear view of the rotatable portion shown in FIG. 5*a;*

FIG. 5*a* is a front view of rotatable portion 118, FIG. 5*b* is a perspective front view of rotatable portion 118 and FIG. 5*c* is a perspective rear view of rotatable portion 118. In the exemplary embodiment, rotatable portion 118 may be a substantially circular shaped disk that includes a first, or front surface 146 and a second, or rear surface 148. Alternatively, rotatable portion 118 may have any shape that enables system 100 to function as described herein. In the exemplary embodiment, front surface 146 may have a coupling member 150 that may be coupled thereto, wherein coupling member 150 may extend away from front surface 146. Coupling member 150 may have a substantially semi-circular shape and an aperture 152 defined therein and extending through coupling member 150. In one embodiment, coupling member 150 may be oriented such that coupling member 150 is substantially aligned with a bisection line 154 of rotatable portion 118, wherein bisection line 154 may substantially bisect rotatable portion 118 along a diameter of rotatable portion 118.

Rear surface 148 may include a cam 156 that may extend away from rear surface 148 and may be positioned substantially near an outer edge of rotatable portion 118. Moreover, cam 156 may be aligned such that bisection line 154 may substantially bisect cam 156. As a result, cam 156 and coupling member 150 may be oriented such that cam 156 and coupling member 150 are substantially aligned along bisection line 154. Cam 156 may include a first cam surface 158 and a second cam surface 160. As described in more detail below, first and second cam surfaces 158 and 160 may contact first and second contact surfaces 138 and 140, respectively, of protrusion 136. Rear surface 148 may also include a rotating pin 164 that may extend generally axially away from rear surface 148 along axis of rotation 120. In one embodiment, rotating pin 164 may be positioned in the center of rotatable portion 118. Moreover, rotating pin 164 may be sized and oriented such that rotating pin 164 may be inserted within center-hole 130 of stationary portion 116 to facilitate rotatably coupling rotatable portion 118 to stationary portion 116.

During assembly of mounting bracket assembly 104, a portion of rotatable portion 118 may be inserted within cavity 132 such that cam 156 is oriented generally opposite cavity 132. Moreover, rotating pin 164 may be inserted within center-hole 130 to facilitate rotatably coupling rotatable portion 118 to stationary portion 116. Semi-circular notch 134 enables rotatable portion 118, and more specifically coupling member 150, to rotate about axis of rotation 120, and more specifically rotating pin 164, without contacting second plate 126. During operation, rotatable portion 118 may rotate about rotating pin 164 such that cam 156 may contact either first contact side 138 of protrusion 136 with first cam surface 158 or second contact side 160 with second cam surface 160. As a result, protrusion 136 facilitates stopping the rotation of rotatable portion 118 at either first position 107 or second position 109. In one embodiment, rotatable portion 118 may rotate between about 0° to about 180°. In another embodiment, rotatable portion 118 may rotate between about 3° to about 177°. In yet another embodiment, rotatable portion 118 may rotate between about 5° to about 175°.

Figure 6A:
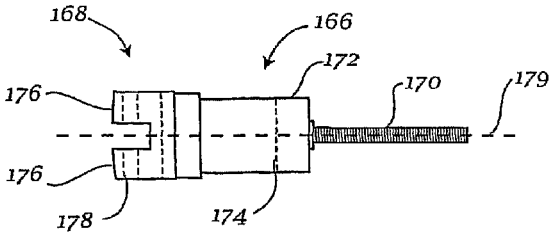
FIG. 6*a* is a side view of a rod insert that may be used with the system shown in FIG. 1.
Figure 6B:
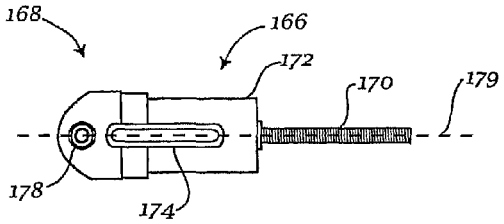
FIG. 6*b* is a top view of the rod insert shown in FIG. 6*a;*

As shown in FIGS. 6*a* and 6*b*, system 100 may include a rod insert 166 that may include a coupling end 168, a fastener 170 and a body 172 extending therebetween, wherein rod insert 166 may be hingedly coupled to coupling member 150 of rotatable portion 118. FIG. 6*a* is a side view of rod insert 166 and FIG. 6*b* is a top view of rod insert 166. In one embodiment, body 172 may have a substantially cylindrical shape and an elongated slot 174 defined within body 172. Moreover, coupling end 168 may include a pair of flanges 176 extending away therefrom, wherein flanges 176 may each have an aperture 178 defined therein. Apertures 178 of each flange 176 may be oriented such that the two apertures 178 are substantially aligned with one another. Further, fastener 170 may be a threaded member such as, but not limited to, a screw that facilitates coupling rod insert 166 to rod 102. Rod insert 166 may also have an insert centerline axis 179 that extends generally axially through the center of rod insert 166.

Figure 7:
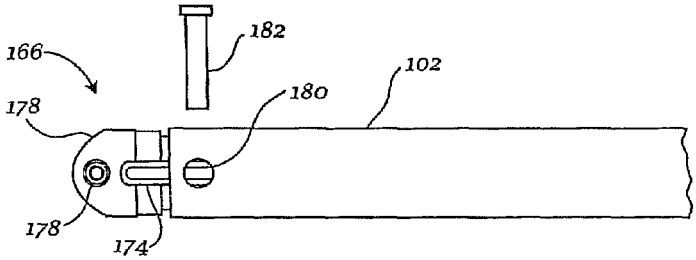
FIG. 7 is a top view of a rod and the rod insert shown in FIG. 6*b;*

As shown in FIG. 7, rod insert 166 may be inserted within curved rod 102. In the exemplary embodiment, curved rod 102 may be an elongated rod that may have a substantially cylindrical shape and may also be substantially hollow such that an internal passageway (not shown) may be defined therein. As a result, the ends of curved rod 102 may include an opening defined therein. Further, the end of curved rod 102 may have a pair of apertures 180 define therein, wherein apertures 180 may be oriented such that one aperture 180 is positioned substantially opposite of the other aperture 180. In the exemplary embodiment, rod insert 166 may be inserted within curved rod 102 such that apertures 180 may be substantially aligned with elongated slot 174 of rod insert 166. In such an embodiment, a pin 182 may be inserted through apertures 180 and through elongated slot 174 such that rod insert 166 may be slidably coupled to rod 102. As a result, rod insert 166 facilitates adjusting the length of rod 102 such that a plurality of rods having a variety of lengths may be adjusted using rod insert 166 to fit the specific dimensions of a user's bathroom. Moreover, rod insert 166 facilitates stabilizing rod 102 as rod 102 is moved between first position 107 and second position 109.

Figure 8:
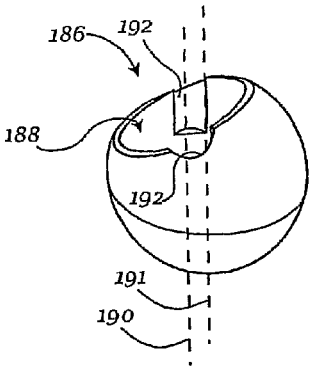
FIG. 8 is a perspective view of a swivel collar that may be used with the system shown in FIG. 1.
Figure 9:
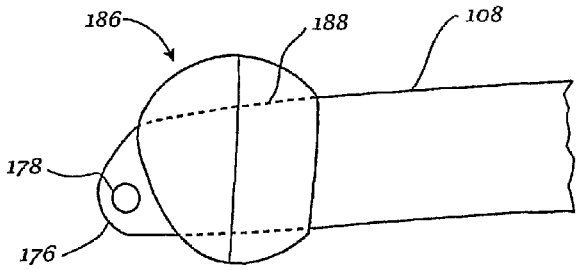
FIG. 9 is a perspective view of a rod coupled to the swivel collar that may be used with the system shown in FIG. 1.

Turning to FIGS. 8 and 9, in the exemplary embodiment, curved rod 102 may include a swivel collar 186 coupled thereto. FIG. 8 is an enlarged perspective side view of swivel collar 186 and FIG. 9 is an enlarged perspective side view of rod 102 coupled to swivel collar 186. In the exemplary embodiment, swivel collar 186 may have a generally spherical shape and may have a passage 188 defined therethrough that extends along a passage centerline axis 190, wherein passage 188 may be sized such that rod 102 may be inserted therethrough. In one embodiment, passage centerline axis 190 may be substantially parallel to a swivel collar centerline axis 191 that may be position on a line that bisects swivel collar 186 along a diameter of swivel collar 186. Moreover, passage centerline axis 190 may be positioned such that passage centerline axis 190 is not co-axial with swivel collar centerline axis 191. As a result, passage 188 may be offset from swivel collar centerline axis 191 such that passage 188 generally does not extend through the center of swivel collar 186. Rather, in the exemplary embodiment, passage 188 may be positioned substantially close to one side of swivel collar 186. Alternatively, passage 188 may extend through the center of swivel collar 186. In the exemplary embodiment, swivel collar 186 facilitates orienting curved rod 102 at an angle with respect to axis of rotation 120 of rotator mount assembly 110.

In one embodiment, swivel collar 186 may include a pair of slots 192 defined within a sidewall of passage 188 to facilitate receiving a portion of insert pin 182, wherein insert pin 182 may be inserted within apertures 180 of rod 102 such that at least a portion of insert pin 182 may extend away from rod 102. As a result, slots 192 facilitate receiving the extended portion of pin 182 therein.

Figure 10:
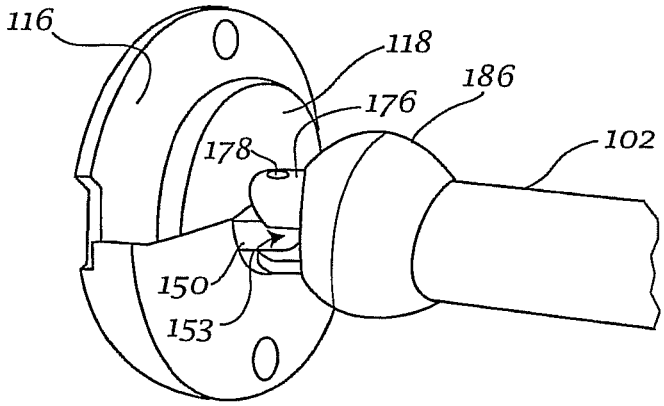
FIG. 10 is a perspective view of the rod coupled to the rotatable mount assembly that may be used with the system shown in FIG. 1.
Figure 11A:
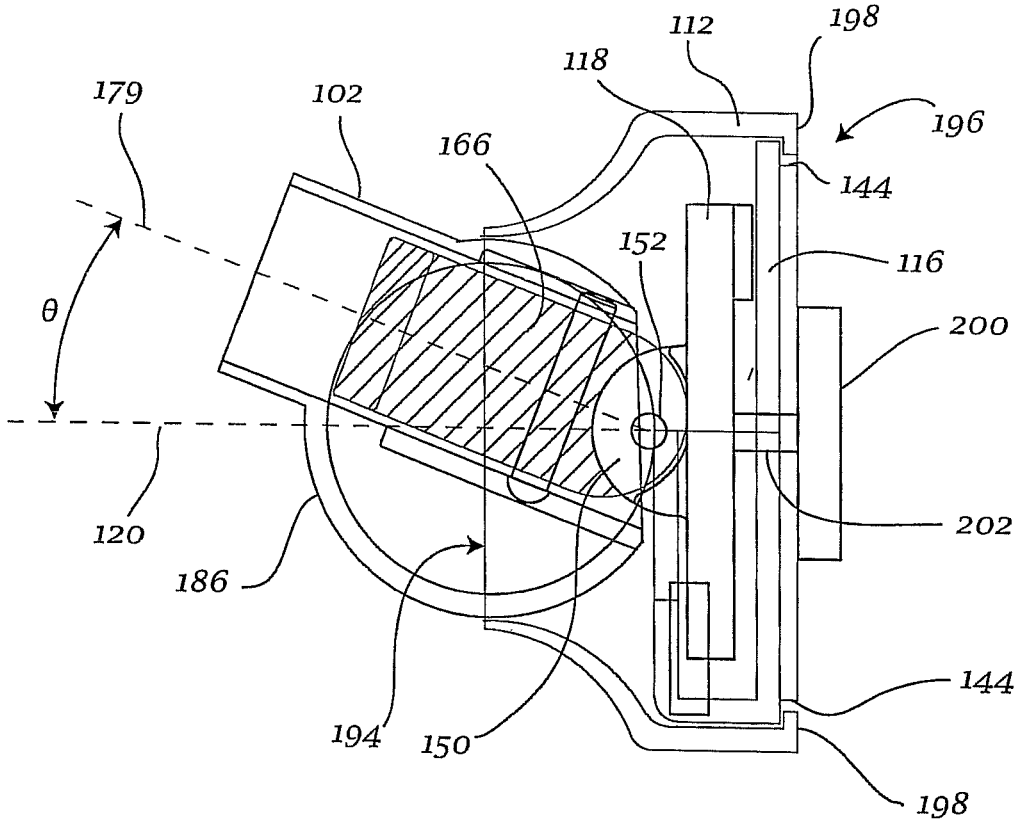
FIG. 11*a* is a cross-sectional side view of the rod coupled to the rotatable mount assembly shown in FIG. 10.

As shown in FIGS. 10 and 11, coupling end 168 of rod insert 166 may be coupled to coupling member 150 of rotatable portion 118 to facilitate coupling curved rod 102 to mounting bracket assembly 104. FIG. 10 is a perspective view of curved rod 102 coupled to rotatable mount assembly 110 and FIG. 11 is a cross-sectional side view of curved rod 102 coupled to mounting bracket assembly 104. Coupling end 168 may engage coupling member 150 such that coupling member 150 may be positioned between flanges 176. Moreover, apertures 178 of coupling end 168 may be substantially aligned with aperture 152 of coupling member 150 such that an insert pin (not shown in FIG. 11) may be inserted through apertures 178 and aperture 152 to facilitate hingedly coupling rod insert 166 to rotatable portion 118. When rod insert 166 and rotatable portion 118 are coupled, coupling apertures 153 may be formed between coupling member 150 and flanges 176.

As shown in FIG. 10, swivel collar 186 facilitates orienting rod insert 166, and more specifically the end of rod 102, at an angle θ with respect to axis of rotation 120. Specifically, insert centerline 179 of rod insert 166 may be oriented at angle θ with respect to axis of rotation 120 of rotator mount assembly 104. In one embodiment, angle θ may have a range between about 6° to about 36°. In another embodiment, angle θ may have a range between about 16° to about 26°. In yet another embodiment, angle θ may be about 21°.

Figure 11B:
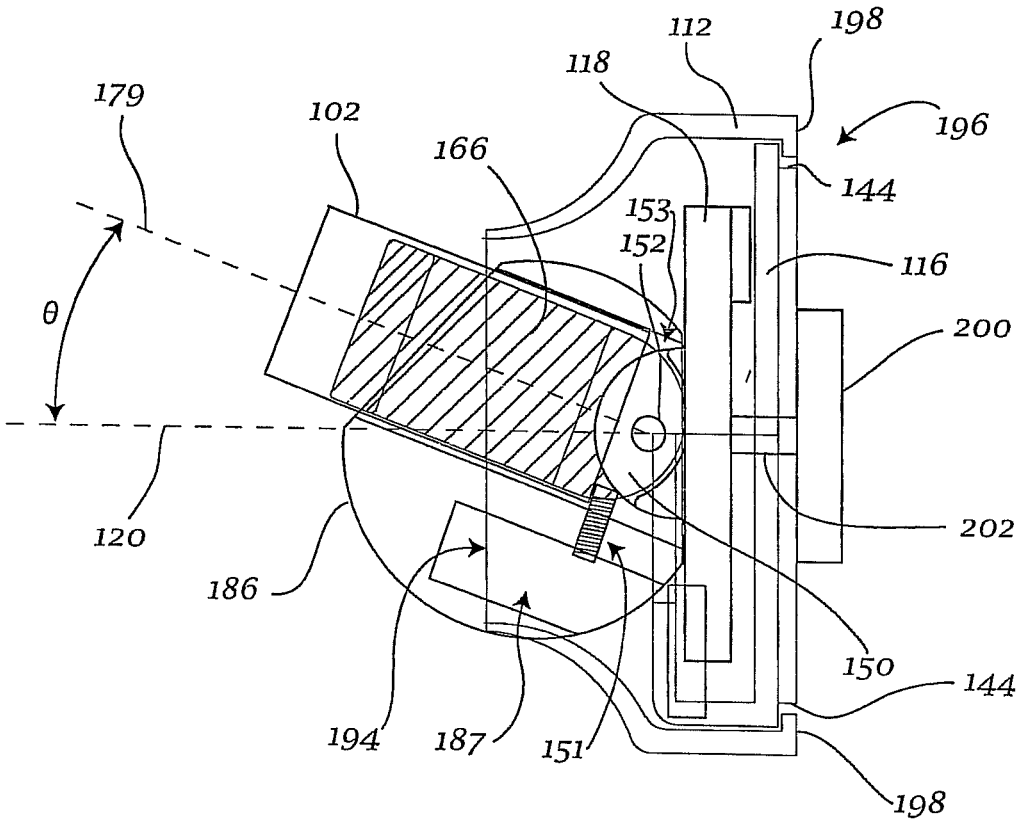
FIG. 11*b* is another cross-section side view of the rod coupled to the rotatable mount assembly show in FIG. 10.

In another embodiment, as shown in FIG. 11*b*, swivel collar 186 may have collar aperture 187. Collar aperture 187 may have fastener 151 therein. Fastener 151 may be, for example, a set screw, pin or the like. Fastener 151 may be on an interior wall of collar aperture 187 such that fastener 151 may be situated between collar aperture 187 and passage 188. Fastener 187 may be selectively rotated, slided or otherwise moved such that fastener removably penetrates more or less into passage 188. Swivel collar 186 and rod 102 may engage rod insert 166 such that set fastener 151 aligns with coupling apertures 153. Fastener 151 may be selectively rotated, slided or otherwise moved such that fastener 151 may engage at least one coupling aperture 153.

In the exemplary embodiment, cover 112 may be coupled to stationary portion 116 using locking slots 144. In one embodiment, cover 112 may include a first opening 194, a second opening 196 and a pair of locking flanges 198 that extend radially inward from an inner surface (not shown) of cover 112, wherein locking flanges 198 may be positioned substantially near second opening 196. Locking flanges 198 may engage locking slots 144 of stationary portion 116 to facilitate coupling cover 112 to stationary portion 116 to form rotatable mount assembly 104. In one embodiment, first opening 194 may have a diameter (not shown) that may be sized such that the diameter of first opening 192 may be configured to receive the diameter of swivel collar 186.

In one embodiment, mounting bracket assembly 104 may include a motor 200 that may be operatively coupled thereto using a rotating shaft 202. In such an embodiment, motor 200 may facilitate rotating rod 102 between first position 107 and second position 109.

During operation curved rod 102 may be coupled to rotator mount assemblies 104 such that curved rod 102 extends therebetween. Liner 106 may be slidably coupled to rod 102. In the event a user (not shown) is using the shower, the user may rotate curved rod 102 to first position 107 to facilitate increasing the space within the shower area. Specifically, when curved rod 102 is positioned in first position 107, the curved portion of curved rod 102 may curve generally away from the shower area. As a result, liner 106 may also curve away from the shower area to facilitate increasing the space within the shower.

In one embodiment, the user may physically move curved rod 102 to first position 107. Alternatively, motor 200 may rotate curve rod 102 to first position 107 by rotating rotatable portion 118. Rotatable portion 118 may rotate about axis of rotation 120 until first cam surface 158 contacts first contact surface 138 of protrusion 136. As a result, protrusion 136 and more specifically first contact surface 138, facilitates preventing the rotation of rotatable portion 118 and facilitates positioning curved rod 102 in first position 107.

Curved rod 102 may also be moved from first position 107 to second position 109 to facilitate increasing the bathroom space, which also facilitates decreasing the shower space. Specifically, the user may physically move curved rod 102 such that rotatable portion 118 rotates about axis of rotation 120 from first contact surface 138 towards second contact surface 140. Alternatively, motor 200 may rotate curved rod 102 to second position 109 by rotating rotatable portion 118. Once second cam surface 160 contacts second contact surface 140 of protrusion 136, curved rod 102 may be generally positioned in second position 109. As a result, curved rod 102 may be oriented such that curved rod 102 may curve towards the shower area and away from the bathroom area. More specifically, liner 106 may also curve towards shower area and away from the bathroom area. As such, the space within the shower area is facilitated to be reduced and the space in the bathroom area is facilitated to be increased.

Figure 12A:
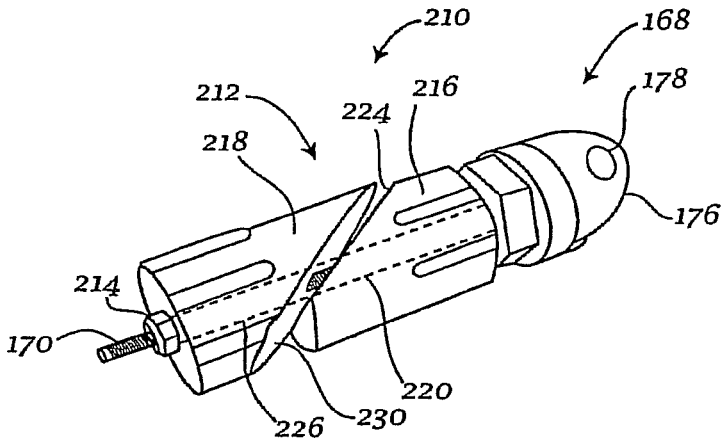
FIG. 12*a* is a perspective view of an alternative insert that may be used with the system shown in FIG. 1.
Figure 12B:
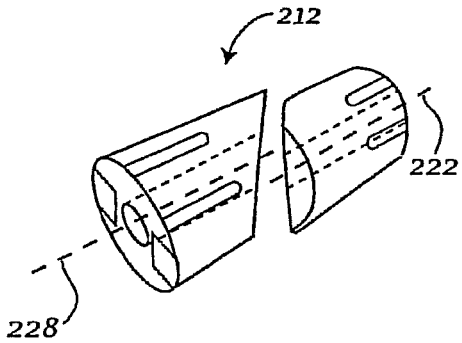
FIG. 12*b* is a perspective view of an insert body assembly of the insert shown in FIG. 12*a;*
Figure 12C:
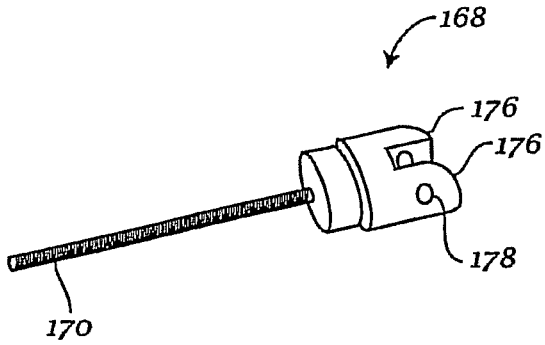
FIG. 12*c* is a perspective view of a coupling end of the insert shown in FIG. 12*a;*

FIGS. 12*a*-12*c* are perspective views of an alternative insert 210. Components of insert 210 may be substantially similar to components of rod insert 166, and like components are identified with like reference numerals. Specifically, FIG. 12*a* is a perspective view of insert 210, FIG. 12*b* is a perspective view of an insert body assembly 212 and FIG. 12*c* is a perspective view of coupling end 168. Insert 210 may include a coupling end 168 that may be coupled to insert body assembly 212. In one embodiment, coupling end 168 may include a pair of flanges 176, such that coupling end 168 may be a knuckle joint. Moreover, flanges 176 may have a pair of apertures 178 defined therein. Moreover, coupling end 168 may also include a fastener 170 coupled thereto using a retaining nut 214. In one embodiment, for example, fastener 170 may be a threaded member such as, but not limited to, a screw.

In the exemplary embodiment, insert body assembly 212 may include a first insert body 216 and a second insert body 218. First insert body 216 may have a substantially cylindrical shape and a first center passageway 220 extending therethrough that may be substantially coaxial with a first center axis 222 (shown in FIG. 12*b*) of first insert body 216. Moreover, first insert body 216 may include a first face 224 that may be oriented at an angle that is substantially oblique with respect to first center axis 222 of first insert body 216. Second insert body 218 may also have a substantially cylindrical shape and a second center passageway 226 that is substantially coaxial with a second center axis 228 (shown in FIG. 12*b*) of second insert body 218. In one embodiment, first passageway 220 and second passageway 226 may be aligned such that first passageway 220 and second passageway 226 are substantially coaxial. Second insert body 218 may also have a second face 230 that is substantially similar to first face 224. Specifically, second face 230 may be oriented at an angle that is substantially oblique with respect to second center axis 228 of second insert body 218. Moreover, first and second faces 224 and 230 may be oriented such that first and second faces 224 and 230 are slidably coupled to each other.

Insert 210 is formed by coupling first and second insert bodies 216 and 218 to coupling end 168. Specifically, fastener 170 may be inserted through first passageway 220 and second passageway 226 such that first face 224 is slidably coupled to second face 230. Retaining nut 214 may be coupled to second insert body 218 such that a portion of fastener 170 may be coupled to retaining nut 214. In one embodiment, for example, retaining nut 214 may be threadably coupled to fastener 170. During operation, fastener 170 may rotate with respect to retaining nut 214 such that first insert body 216 may be coupled to second insert body 218. Tightening fastener 170 facilitates sliding first insert body 216 with respect to second insert body 218 along first and second faces 224 and 230, such that an overall circumference (not shown) of insert 210 is increased, which facilitates coupling insert 210 within rods that may have hollow openings of various circumferences.

Insert 210 facilitates stabilizing the rotation of rod 102 from first position 107 to second position 109 during pivoting. Moreover, insert 210 facilitates adjusting a length of rod 102 by varying the distance insert 210 may be inserted into rod 102. As a result, insert 210 facilitates adjusting the length of rod 102 to enable rod 102 to fit varying sized shower and tub walls.

Figure 13:
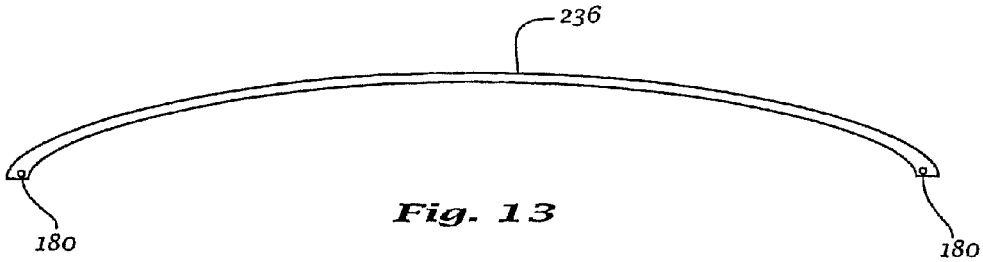
FIG. 13 is an illustration of an alternative rod that may be used with the system shown in FIG. 1.

FIG. 13 is an illustration of an alternative curved rod 236. Components of curved rod 236 may be substantially similar to components of rod 102, and like components are identified with like reference numerals. Curved rod 236 may have a substantially circular cross-sectional shape and may have a substantially arcuate shape. Alternatively, curved rod 236 may have a cross-sectional shape of any type of shape. Curved rod 236 may also have a plurality of apertures 180 defined near the ends of curved rod 236. In one embodiment, a pair of apertures 180 may be defined in each end of curved rod 236. Moreover, the pair of apertures 180 may be oriented such that one aperture 180 is positioned substantially opposite the other aperture on curved rod 236 to facilitate slidably coupling a pin (not shown) to curved rod 236.

Figure 14:
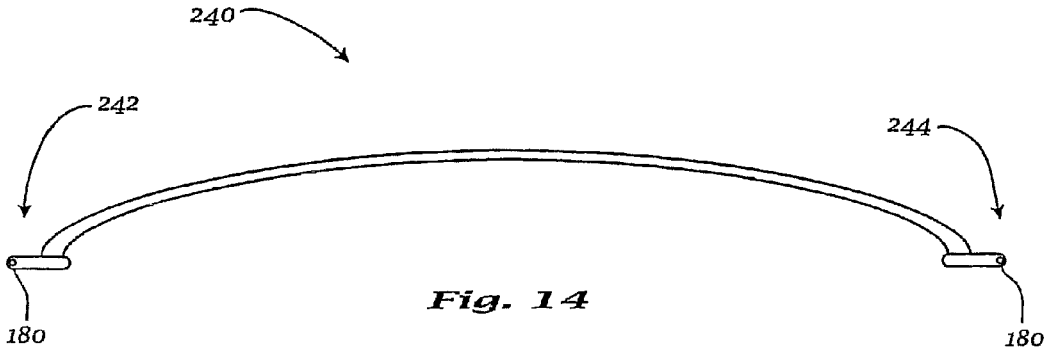
FIG. 14 is an illustration of another alternative rod that may be used with the system shown in FIG. 1.

FIG. 14 is an illustration of an alternative curved rod 240. Components of curved rod 240 may be substantially similar to components of rod 102, and like components are identified with like reference numerals. Curved rod 240 may have a substantially Ω-shape. Specifically, curved rod 240 may include a first end portion 242, a second end portion 244 and an arcuate portion 246 extending therebetween. First and second end portions 242 and 244 may be substantially straight. Moreover, first and second end portions 242 and 244 may have an opening (not shown) such that insert 166 may be coupled within each opening. Curved rod 240 may also have a plurality of apertures 180 defined near the ends of curved rod 240. In one embodiment, a pair of apertures 180 may be defined in each end of curved rod 240. Moreover, the pair of apertures 180 may be oriented such that one aperture 180 is positioned substantially opposite the other aperture 180 on curved rod 240 to facilitate slidably coupling a pin (not shown) to curved rod 240.

Figure 15A:
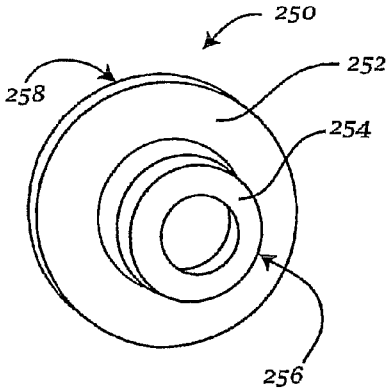
FIG. 15*a* is a perspective view of an alternative cover that may be used with the system shown in FIG. 1.
Figure 15B:
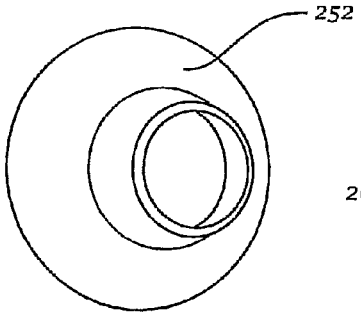
FIG. 15*b* is a perspective view of a cover body portion of the cover shown in FIG. 15*a;*
Figure 15C:
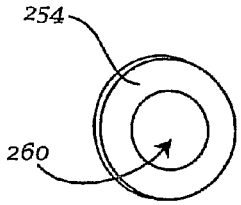
FIG. 15*c* is a perspective view of a cover cap that may be used with the cover shown in FIG. 15*a;*

FIGS. 15*a*-15*c* are perspective views of an alternative cover 250. FIG. 15*a* is a perspective view of cover 250, FIG. 15*b* is a perspective view of a cover body portion 252 and FIG. 15*c* is a perspective view of cover cap 254. In the exemplary embodiment, cover 250 may include cap body portion 252 and cover cap 254 coupled thereto. Cap body portion 252 may have a substantially conical shape extending along a centerline axis (not shown). Cap body portion 252 may also have a first end, or rod end opening 256 and a second end, or mounting end opening 258. In one embodiment, rod end opening 256 may have a diameter (not shown) that is substantially smaller than a diameter of mounting end opening 258. In the exemplary embodiment, cover cap 254 may include an aperture 260 defined therein, wherein aperture 260 has a diameter (not shown) that is substantially smaller than the diameter of rod end opening 256. Aperture 260 may be sized to receive rod 102 therein. Moreover, cover 250 facilitates covering rotator mount assembly 110.

Figure 16:
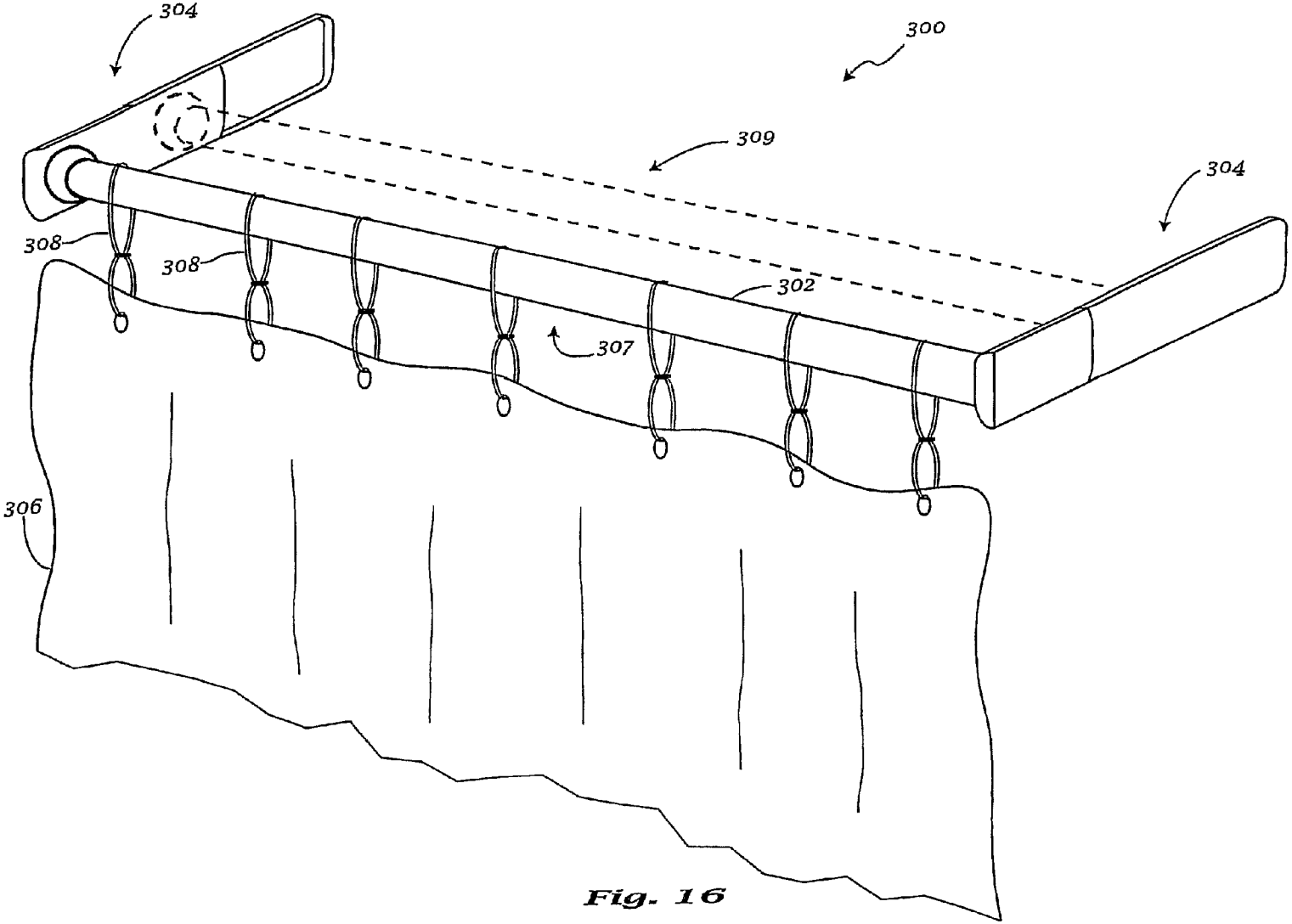
FIG. 16 is a perspective view of an alternative shower rod system.

FIG. 16 is a perspective view of an alternative shower rod system 300. In the exemplary embodiment, system 300 may be a sliding system wherein a rod 302 may slide towards and away from a shower area to facilitate increasing the usable shower space while the shower is in use and facilitate increasing the bathroom space when the shower is not in use. System 300 may include a pair of sliding brackets 304 and rod 302 extending therebetween. In the exemplary embodiment, rod 302 may be substantially straight. As a result, any known shower rod may be used with system 300. In one embodiment, rod 302 may be extendable. System 300 may also include a liner 306 and a plurality of liner fasteners 308 that facilitate slidably coupling liner 306 to rod 302. Moreover, sliding brackets 304 facilitate sliding rod 302 from a first position 307 to a second position 309, as described below in more detail. In the exemplary embodiment, first position 307 of rod 302 and more specifically liner 306 is positioned a distance (not shown) away from the shower area. As such, first position 307 of rod 302 facilitates increasing the space of the shower area. Moreover, second position 309 of rod 302 and liner 306 is positioned a distance that is closer to the shower area than first position 307. As a result, second portion 309 of rod 302 facilitates increasing the bathroom space and facilitates decreasing the shower space.

Figure 17:
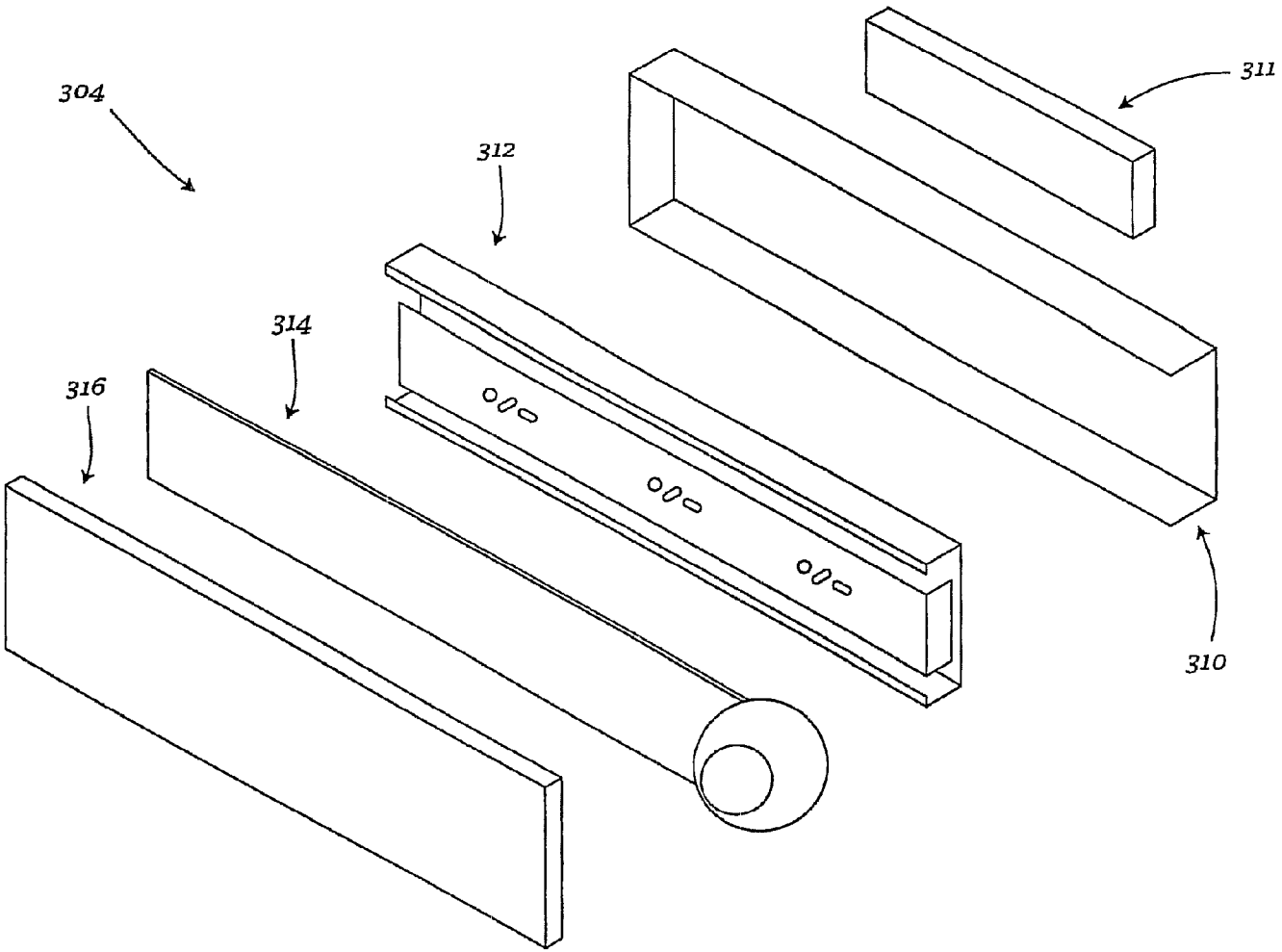
FIG. 17 is an exploded view of the system shown in FIG. 16.
Figure 18A:
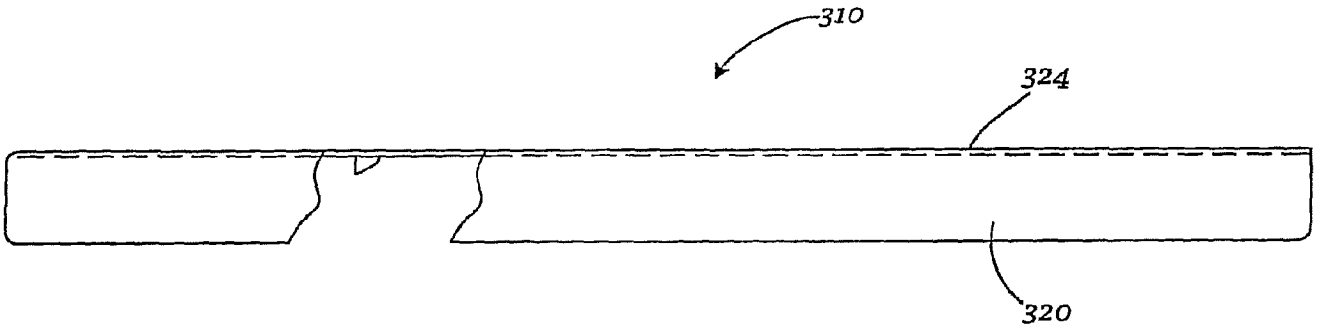
FIG. 18*a* is a top view of a wall mount that may be used with the system shown in FIG. 16.
Figure 18B:
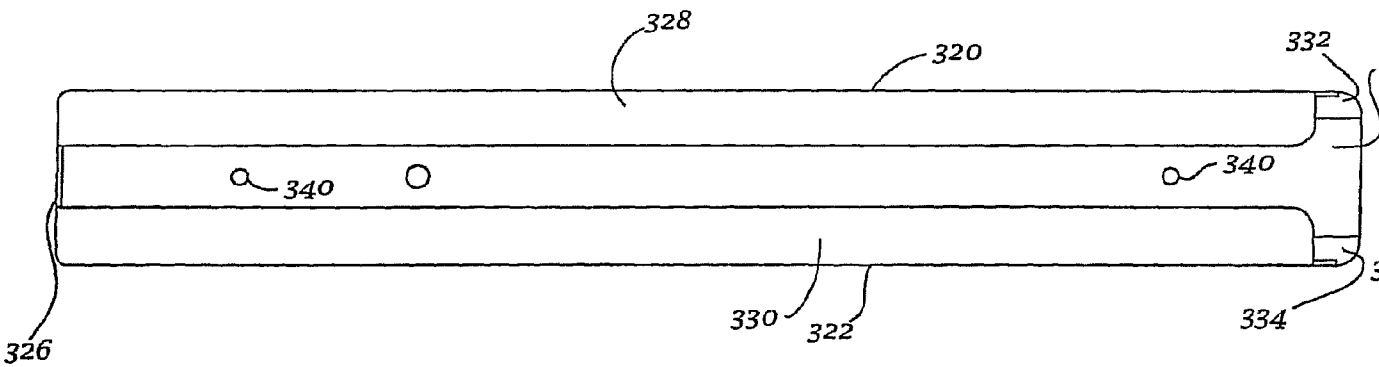
FIG. 18*b* is a side view of the wall mount shown in FIG. 18*a;*
Figure 18C:
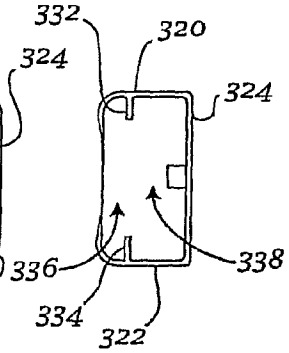
FIG. 18*c* is an end view of the wall mount shown in FIG. 18*a;*

FIG. 17 is an exploded view of sliding bracket 304. Each sliding bracket 304 may include a wall mount 310, a sliding assembly 312, a right, or first chassis cover 314, a left, or second chassis cover 315 (shown in FIGS. 21*a*-21*c*), and a cover plate 316. In one embodiment, a motor 311 may be coupled to sliding brackets 304 to facilitate sliding rod 302 between first position 307 and second position 309. In the exemplary embodiment, wall mount 310 may have a substantially rectangular shape, as shown in FIGS. 18*a*-18*c*. Specifically, FIG. 18*a* is a top view of wall mount 310, FIG. 18*b* is a side view of wall mount 310 and FIG. 18*c* is an end view of wall mount 310. Wall mount 310 may include a top wall 320, a bottom wall 322, a rear wall 324 and a side wall 326. Wall mount may also include a top front wall 328 that may be coupled to top wall 320, and a bottom front wall 330 that may be coupled to bottom wall 322. A space (not shown) may be defined between top front wall 328 and bottom front wall 330. Wall mount 310 may also include a top flange 332 and a bottom flange 334 that each extend away from top wall 320 and bottom wall 322 respectively. As a result, a front cavity area 336 may be generally defined between top and bottom front walls 328 and 330, and top and bottom flanges 332 and 334. Moreover, a rear cavity area 338 may be defined between rear wall 324 and top and bottom flanges 332 and 334. As described in more detail below, sliding assembly 312 may be coupled within rear cavity area 338 and cover plate 316 may be coupled within front cavity area 336. Wall mount 310 may also have a plurality of mounting apertures 340 defined within rear wall 324 to facilitate coupling wall mount 310 to a bathroom wall using plurality of fasteners (not shown).

Figure 19B:
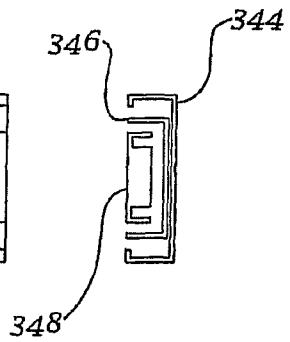
FIG. 19*b* is an end view of the sliding assembly shown in FIG. 19*a;*
Figure 19A:
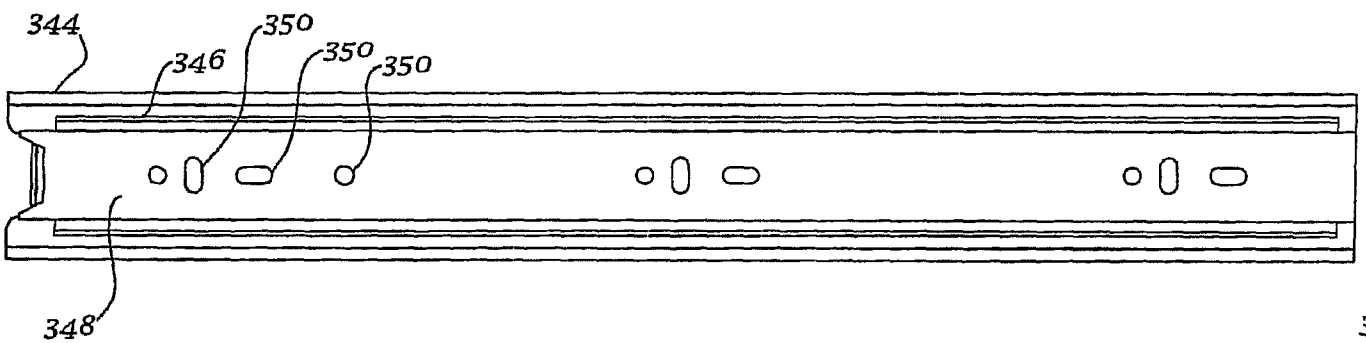
FIG. 19*a* is a side view of a sliding assembly that may be used with the system shown in FIG. 16.

Turning to FIGS. 19*a* and 19*b*, in the exemplary embodiment, sliding assembly 312 may include a stationary portion 344, a first sliding portion 346 and a second sliding portion 348. Stationary portion 344 may be coupled to wall mount 310 using any coupling means known to a person having ordinary skill in the art. Moreover, first sliding portion 346 may be slidably coupled to stationary portion 344 and second sliding portion 348 may be slidably coupled to first sliding portion 346. Second sliding portion 348 may have a plurality of attachments apertures 340 defined therein that facilitate coupling first and second chassis covers 314 and 315 to sliding assembly 312, as described in more detail below.

Figure 20A:
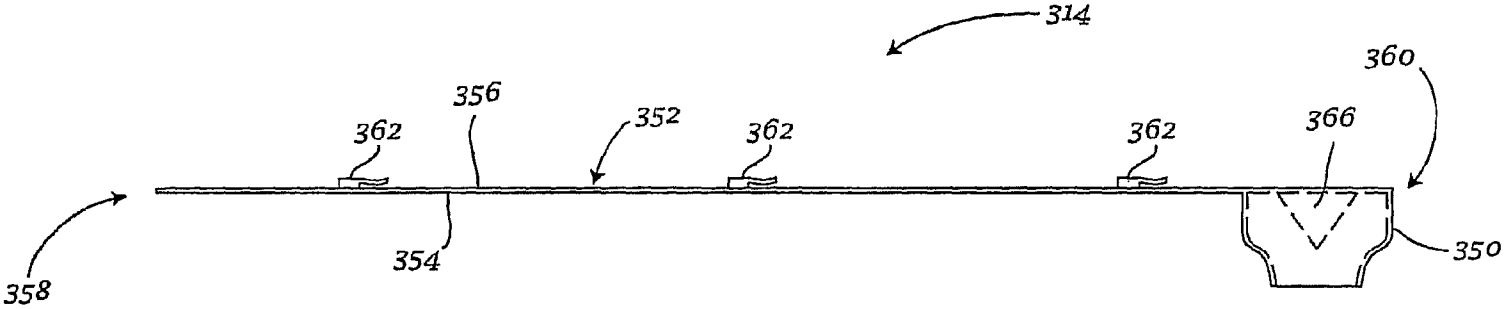
FIG. 20*a* is a top view of a first chassis cover that may be used with the system shown in FIG. 16.
Figure 20B:
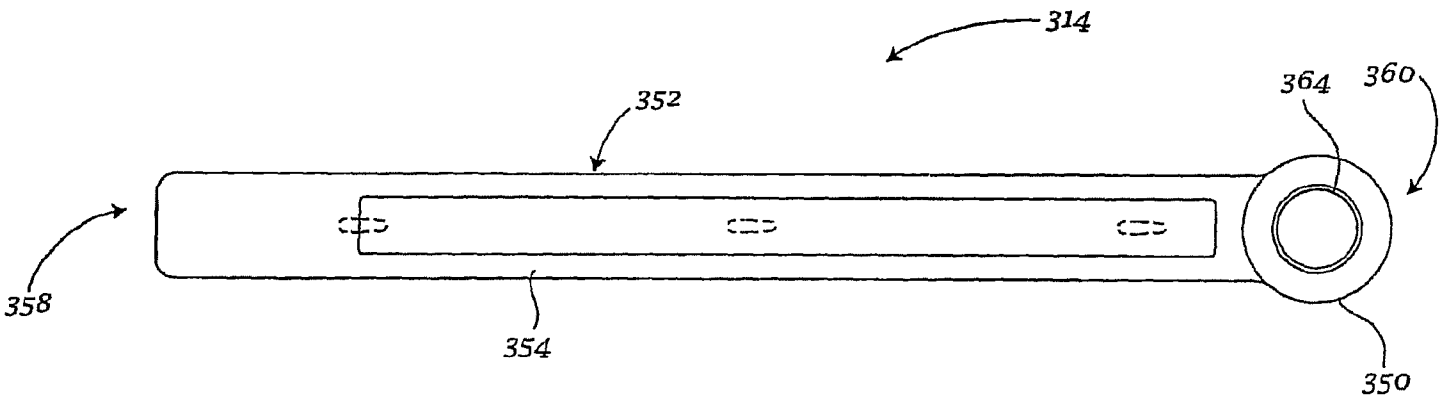
FIG. 20*b* is a side view of the first chassis cover shown in FIG. 20*a;*

FIGS. 20*a* and 20*b* are illustrations of first chassis cover 314. Specifically, FIG. 20*a* is a top view of first chassis cover 314 and FIG. 20*b* is a side view of first chassis cover 314. First chassis cover 314 may include a body portion 352 that has a front surface 354, a rear surface 356, a first end 358 and a second end 360. A plurality of fasteners 362 may be coupled to rear surface 356 and extend away therefrom. Fasteners 362 facilitate coupling first chassis cover 314 to sliding assembly 312, and more specifically second sliding portion 348. Moreover, a first rod socket 350 may be coupled to front surface 354 and may be position substantially near second end 360. First rod socket 350 may have a substantially conical shape and include a first opening 364 that may have a first diameter (not shown) that may be sized to receive an end of rod 302. Moreover, first rod socket 350 may include a rod stabilizer 366 coupled therein. In the exemplary embodiment, rod stabilizer 366 may have a substantially conical shape and may be positioned opposite first opening 364.

Figure 21A:
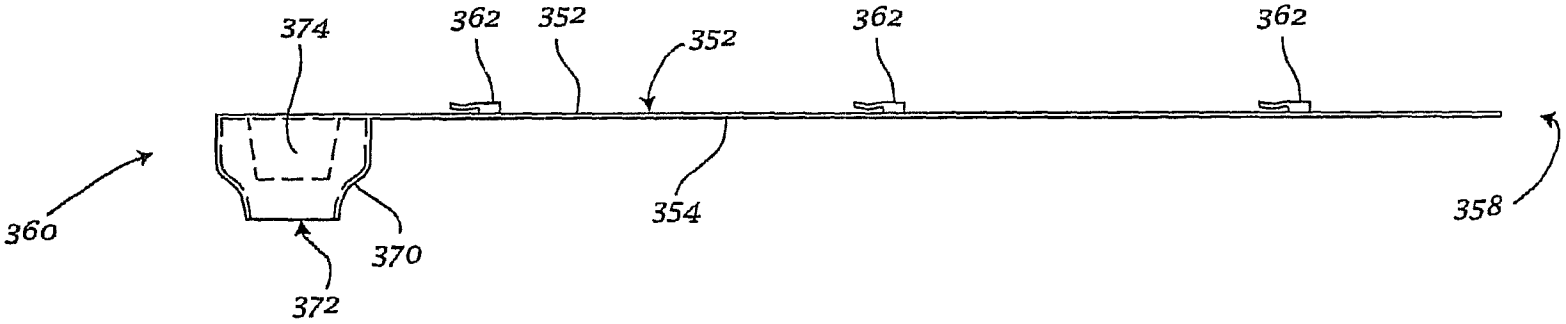
FIG. 21*a* is a top view of a second chassis cover that may be used with the system shown in FIG. 16.
Figure 21B:
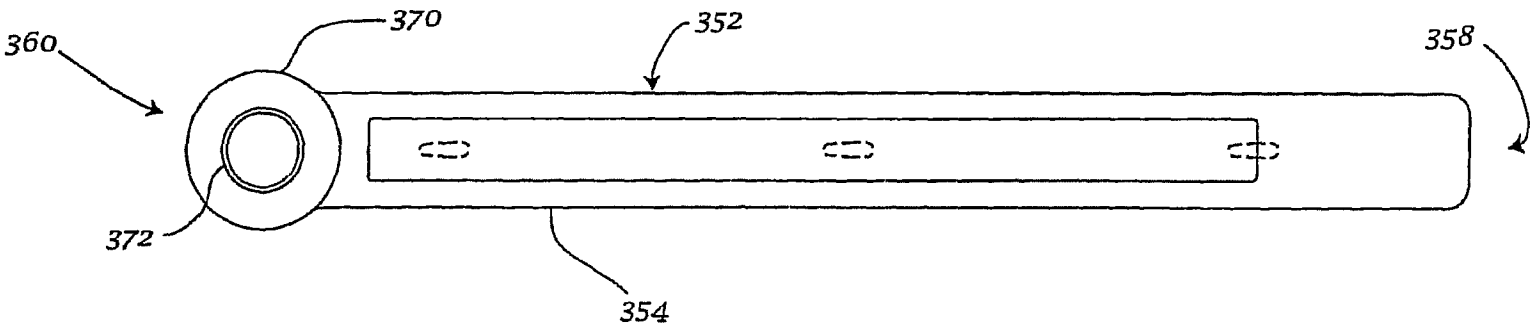
FIG. 21*b* is a side view of the second chassis cover shown in FIG. 21*a;*

FIGS. 21*a* and 21*b* are illustrations of second chassis cover 315. Components of second chassis cover 315 may be substantially similar to components of first chassis cover 314, and like components are identified with like reference numerals. Specifically, FIG. 21*a* is a top view of second chassis cover 315 and FIG. 21*b* is a side view of second chassis cover 315. Second chassis cover 315 may include a body portion 352 that has a front surface 354, a rear surface 356, a first end 358 and a second end 360. A plurality of fasteners 362 may be coupled to rear surface 356 and extend away therefrom. Fasteners 362 facilitate coupling second chassis cover 315 to sliding assembly 312, and more specifically second sliding portion 348. Moreover, a second rod socket 370 may be coupled to front surface 354 and may be position substantially near second end 360. Second rod socket 370 may have a substantially conical shape and include a second opening 372 that may have a second diameter (not shown) that may be sized to receive an end of rod 302. Moreover, second rod socket 370 may include a second rod stabilizer 374 coupled therein. In the exemplary embodiment, second rod stabilizer 374 may have a substantially conical shape and may be positioned opposite opening 372.

In the exemplary embodiment, first and second rod sockets 350 and 370 facilitate coupling a standard rod to system 300. For example, first opening 364 of first rod socket 350 may be sized to receive one end of rod 302. Specifically, in the exemplary embodiment, rod 302 may include a smaller end (not shown) and a larger end (not shown). First rod socket 350 may be sized to receive the smaller end therein. Once the smaller end of rod 302 has been inserted within first rod socket 350, first rod stabilizer 366 may be coupled to the smaller end of rod 302 and facilitate stabilizing rod 302. Further, second opening 372 of second rod socket 370 may be sized to receive the larger end of rod 302. Once the larger end of rod 302 has been inserted within second rod socket 370, second rod stabilizer 374 may be coupled to the larger end of rod 302 and facilitate stabilizing rod 302. As a result, the first diameter of first opening 364 of first rod socket 350 may be substantially smaller than the second diameter of second opening 372 of second rod socket 370.

Figure 22B:
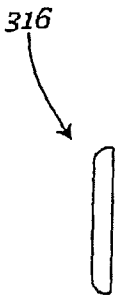
FIG. 22*b* is an end view of the cover plate shown in FIG. 22*a*.
Figure 22A:
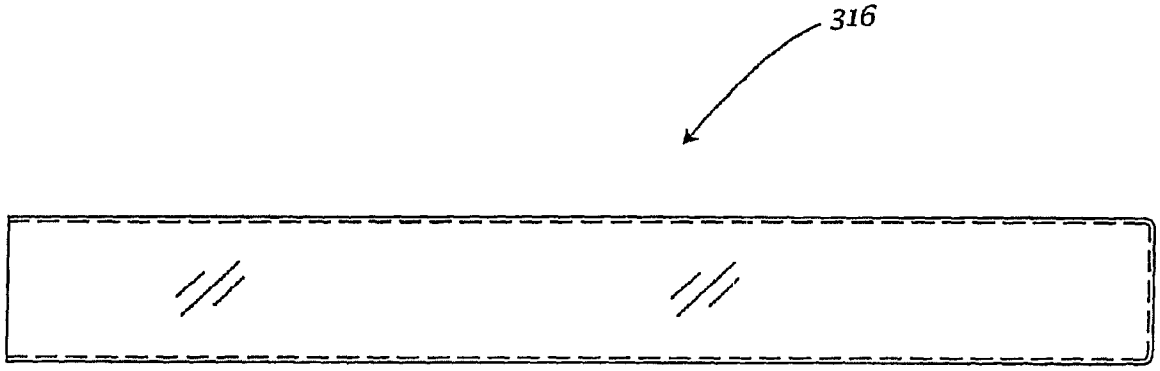
FIG. 22*a* is a side view of a cover plate that may be used with the system shown in FIG. 16.

FIG. 22*a* is a side view of cover plate 316 and FIG. 22*b* is an end view of cover plate 316. In the exemplary embodiment, cover plate 316 may be sized and shaped to substantially fit within front cavity area 366 of wall mount 310.

Figure 23:
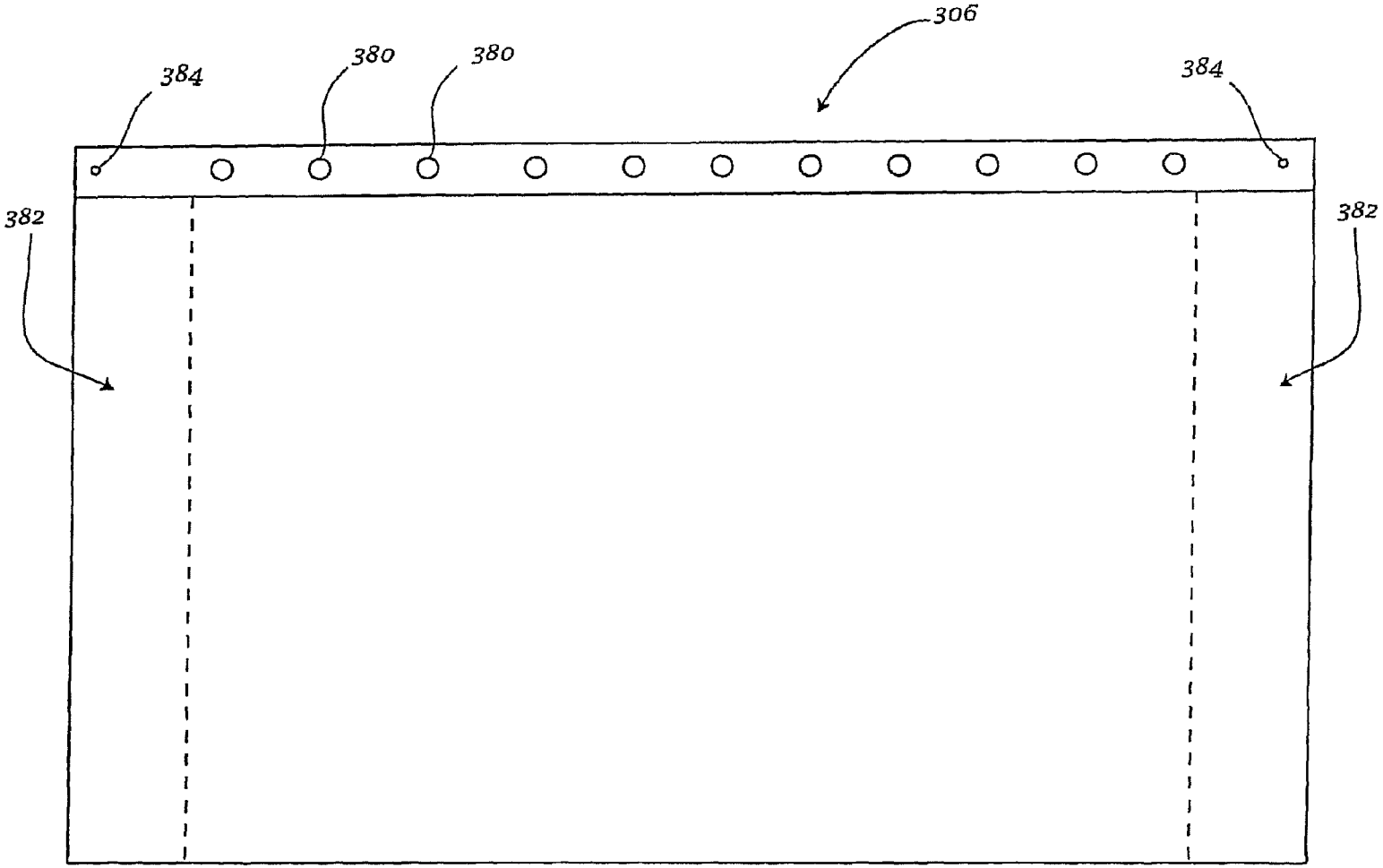
FIG. 23 is a front view of a liner that may be used with the system shown in FIG. 16.

FIG. 23 is a front view of a liner 306. Liner 306 may include a plurality of apertures 380 that may be coupled to a plurality of liner fasteners 308 (shown in FIG. 16). Liner 306 may also include an extension portion 382 which facilitates extending the width (not shown) of liner 306. Liner 306 may also include an attachment mechanism 384 that may be positioned substantially near the top of liner 306 and substantially near the side edges of liner 306. Attachment mechanisms 384 may be coupled to sliding brackets 304. As a result, attachment mechanisms 384 facilitate anchoring a portion of liner 306 to sliding brackets 304, which prevents water from splashing out when rod 302 is in first position 307, as described in more detail below.

System 300 may be assembled by coupling a pair of wall mounts 310 to the wall. One wall mount 310 may be couple to one wall and another wall mount 310 may be coupled to an opposite wall such that the pair of wall mounts 310 may be positioned substantially opposite one another. Rod 302 may extend between the pair of wall mounts 310. Sliding assembly 312 may be coupled to wall mount 310, and more specifically, sliding assembly 312 may be coupled within rear cavity area 338 of wall mount 310. First and second chassis covers 314 and 315 may be coupled to second sliding portion 348 of sliding assembly 312. Specifically, fasteners 362 may be coupled to attachment apertures 340 defined on second sliding portion 348. Cover plate 316 may be coupled to wall mount 310, and more specifically, cover plate 316 may be slidably coupled within front cavity area 336 to facilitate covering first and second chassis covers 314 and 315.

During operation rod 302 may be coupled to sliding brackets 304 such that rod 302 extends therebetween. Liner 306 may be slidably coupled to rod 102 using liner fasteners 308. Moreover, extension portions 382 of liner 306 may be coupled to sliding brackets 304 to facilitate preventing water from splashing out of shower area when rod 302 is in first position 307. In the event a user (not shown) is using the shower, the user may physically move rod 302 from second position 309 to first position 307 to facilitate increasing the space within the shower area. Alternatively, motor 311 may slide rod 302 to first position 307. Specifically, in the exemplary embodiment, first and second chassis covers 314 and 315 may be coupled to second sliding portion 348 which may slide with respect to first sliding portion 346. Moreover, first sliding portion 346 may slide with respect to stationary portion 344 and wall mount 310. As a result, first position may be positioned a distance (not shown) away from second position 309 wherein the distance may be substantially equal to the combined lengths (not shown) of first and second sliding portions 346 and 348. As such, rod 302 and liner 306 facilitate increasing the shower area when rod 302 is in first position 307.

Once the user is finished with the shower, the user may physically move rod 302 from first position 307 to second position 309, which facilitates increasing the bathroom space and facilitates decreasing the shower space. Alternatively, motor 311 may move rod 302 from first position 307 to second position 309.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A rotatable shower rod system comprising:

a pair of mounting brackets coupled to a wall, said pair of mounting brackets comprising:

a stationary portion;

a rotatable portion rotatably coupled to said stationary portion, said rotatable portion rotates to at least one of a first position and a second position about an axis of rotation, wherein said rotatable portion further comprises:

a first surface comprising a coupling member extending away therefrom, said coupling member comprises at least one aperture defined therein; and a second surface comprising:

a cam extending away therefrom, said cam comprises a first cam surface and a second cam surface; and a pivoting pin rotatably coupled to said stationary portion, said pivoting pin facilitates rotating rotatable portion to at least one of said first position and said second position;

a cover coupled to said stationary portion;

a curved rod extending between said pair of mounting brackets; and a rod insert comprising:

a body with a distal end and a coupling end;

at least one flange extending away from said coupling end; and at least one aperture defined within said at least one flange.

2. A rotatable shower rod system in accordance with claim 1, wherein said curved rod is extendable.

3. A rotatable shower rod system in accordance with claim 1 further comprising a liner slidably coupled to said curved rod.

4. A rotatable shower rod system in accordance with claim 1, wherein said stationary portion further comprises:

a first plate, a second plate and a sidewall extending therebetween;

a center-hole defined in said first plate; and a protrusion extending away from said first plate, said protrusion comprising a first contact surface and a second contact surface.

5. A rotatable shower rod system in accordance with claim 1, further comprising a swivel collar coupled to said curved rod, said swivel collar comprising:

a passage defined therein, said passage oriented to facilitate aligning said curved rod at an angle with respect to said axis of rotation; and a collar aperture defined therein, said collar aperture situated between an exterior surface of said swivel collar and said passage.

6. A rotatable shower rod system in accordance with claim 5, further comprising:

a fastener removably situated between said passage and said collar aperture, said fastener removably coupling said swivel collar to said rod insert.

7. A rotatable rod system in accordance with claim 6, wherein the fastener removably couples said swivel collar to said rod insert by coupling to a coupling aperture formed between the at least one flange and the coupling member.

8. A rotatable rod system in accordance with claim 6, wherein the fastener includes a set screw.

9. A rotatable rod system in accordance with claim 6, wherein the fastener is selectively rotated, slided or moved such that said fastener penetrates further into said passage.

10. A rotatable rod system in accordance with claim 6, wherein access to said fastener is provided via said collar aperture.

11. A rotatable shower rod system in accordance with claim 1 further comprising a motor coupled to said rotatable portion, said motor facilitates rotating said rotatable portion between said first position and said second position.

12. A rotatable shower rod system in accordance with claim 1 further comprising a curved rod comprising:

a first end portion;

a second end portion; and an arcuate portion extending between said first end portion and said second end portion, said arcuate portion comprises a substantially Ω-shape.

* * * * *